US005722548A

United States Patent [19]

Hojnoski

[11] Patent Number: 5,722,548

[45] Date of Patent: Mar. 3, 1998

[54] CORK STOPPER FOR BOTTLES OF WINE

[75] Inventor: David E. Hojnoski, Smithville, Canada

[73] Assignee: Kwik Kork International Inc., Barbados, Barbados

[21] Appl. No.: 750,668

[22] PCT Filed: Jun. 16, 1994

[86] PCT No.: PCT/CA94/00323

§ 371 Date: Dec. 16, 1996

§ 102(e) Date: Dec. 16, 1996

[87] PCT Pub. No.: WO95/34476

PCT Pub. Date: Dec. 21, 1995

[51] Int. Cl.[6] ..... B65D 39/00

[52] U.S. Cl. ..... 215/299; 215/296; 81/3.15; 81/3.49

[58] Field of Search ..... 215/296, 299, 215/300; 81/3.15, 3.41, 3.48, 3.49

[56] References Cited

U.S. PATENT DOCUMENTS

| | | | |
|---|---|---|---|
| 523,972 | 8/1894 | Butterfield | 215/296 |
| 1,204,712 | 11/1916 | Spelling . | |
| 2,046,224 | 6/1936 | Vanderhoof | 215/296 |
| 3,307,727 | 3/1967 | Garay | 215/299 |
| 4,889,251 | 12/1989 | Hojnoski . | |
| 5,636,757 | 6/1997 | Porvaznik | 215/364 |

FOREIGN PATENT DOCUMENTS

| | | | |
|---|---|---|---|
| 1127460 | 12/1956 | France . | |
| 2294931 | 7/1976 | France | 215/296 |
| 1194722 | 6/1965 | Germany . | |
| 2414667 | 10/1975 | Germany | 215/296 |
| 1276485 | 6/1972 | United Kingdom . | |

*Primary Examiner*—Stephen Cronin
*Attorney, Agent, or Firm*—Watson Cole Stevens Davis, P.L.L.C.

[57] ABSTRACT

There is provided a new and useful combination of a bottle stopper and stopper-remover comprising cylindrical stopper means (10) of resilient material, the stopper means (10) having top, bottom and side surfaces and a deep well (14) extending into the stopper (10) from the top surface (16); a hollow sleeve (30) in and substantially conforming in cross-section to the well (14), the sleeve (30) having top and bottom ends and inner and outer surfaces; a series of protruding interference members (36) on the outer surface, at least one detent member (46) on the inner surface (43,44) spaced a predetermined distance from the top and bottom; a pair of openings (47) through opposite sides of the sleeve (30) adjacent the detent (46) on a side of the detent (46) remote from the top end; a pair of longitudinal slits (45) extending from respective ones of said openings (47) to a position spaced from said top end; and puller means (50) for insertion into the sleeve (30), the puller means (30) comprising a top gripper member (52), an elongated stem (54) and a bottom locking means (56); the locking means (56) configured to cause the sleeve (30) to expand to allow passage through the detent (46) of the locking means (56) when the stem (54) is inserted into the top end of the sleeve (30), but to prevent withdrawal of the stem (54) once inserted; whereby when the stopper (10) is radially compressed, as by insertion into a neck (72) of a bottle, an interference fit occurs between the interference members (36) and the resilient surface of the well (14), such that, when the pullermeans (50) has been inserted into the sleeve (30), upward pulling of the puller means (50) will cause the stopper (10) to be removed from the bottle by reason of interference between the locking means (56) and the detent (46).

25 Claims, 3 Drawing Sheets

CORK STOPPER FOR BOTTLES OF WINE

FIELD OF THE INVENTION

The invention relates to a novel device to be incorporated in a bottle stopper for removal of the stopper and to a combination of the device with a stopper. The device has particular application with corks and similar stoppers for wine and the like bottles.

BACKGROUND OF THE INVENTION

The "packaging of beverages" art is replete with novel approaches to providing simplified means for opening the packages, particularly in light of the demands of consumers as well as the demands of high speed production equipment.

Wine and related types of beverages are most often packaged in glass bottles and depending on the kind or quality of the wine, the bottles are sealed with a cork. Some wines are bottle packaged with "screw tops" and movement in this direction is obviously predicated to some extent on meeting consumers' demands for packaging which is easily opened without the necessity of additional equipment.

However, "corking" is still and will continue to play, a large part in wine packaging. Some wines, e.g. champagnes, are corked with stoppers having enlarged heads and which can be grasped and twisted. However, the majority of red, white and rose wines are "corked" with stoppers made out of cork which is recessed in the neck of the bottle requiring some implement such as a corkscrew to extract the cork.

There is in some cases consumer resistance to the use of natural corks in table wine products predicated in large part on the need to use a corkscrew or other device for removal of the cork. Typically, women generally avoid the physical/mechanical requirement for removing corks from table wine products and have demonstrated a reluctance to purchase wine products stoppered with corks, due to the awkwardness of cork removal. Many consumers avoid purchasing "corked" bottles of wine due to the need to uncork the wine, there being some apprehension of breaking up the cork, failing to remove it properly and/or allowing cork particles to drop into the wine.

In "corking" wine, the cork is usually sized to a predetermined size for the particular bottle and after filling the bottle with wine, the cork is peripherally compressed and pushed into the neck of the bottle. Modern high-speed bottling and corking equipment necessitates that the cork be presized and readily acceptable to established corking equipment.

Any modification to a cork stopper therefore must keep in mind the continued necessity of use of the same high-speed corking equipment.

Applicant's invention is directed to providing a cork stopper having associated therewith a device for quick and easy removal of the cork without the necessity of a corkscrew or other like device and which continues to meet the necessary type of established modern day "corking" equipment.

PRIOR ART

There have been attempts in the past to provide a cork stopper with a self-contained pulling device and the United States patent to Spelling, U.S. Pat. No. 1,204,712 is representative of such early prior art devices.

The present inventor's earlier U.S. Pat. No. 4,889,251, issued 26 Dec. 1989, illustrates an improved combination cork and puller which overcomes many of the problems of the prior art, and which is usable with high speed corking equipment. Nonetheless, it has been found that the device disclosed in that patent, while useful in many situations, does not completely answer prior problems. In some small number of cases, the device will fail before removing a cork. It would be desirable to reduce the failure rate to substantially zero.

SUMMARY OF THE INVENTION

The present invention provides improvements in the manner of assembly of the inventive device and in its reliability.

Thus the invention provides a bottle stopper remover for use with a bottle stopper where the stopper is cylindrical and of resilient material and has top, bottom and side surfaces and a deep well extending into the stopper from the top surface; the stopper remover comprising a hollow sleeve substantially confirming in cross-section to the well, the sleeve having top and bottom ends and inner and outer surfaces; a series of protruding interference members on the outer surface, a detent member on the inner surface spaced a predetermined distance from the top and bottom; a pair of openings through opposite sides of the sleeve adjacent the detent on a side of the detent remote from the top end; and a pair of longitudinal slits extending from respective ones of said openings to a position spaced from said top end; and puller means for insertion into the sleeve, the puller means comprising a top gripper member, an elongated stem and a bottom locking means; the locking means configured to cause the sleeve to expand to allow passage through the detent of the locking means when the stem is inserted into the top end of the sleeve, but to cause the locking means to prevent withdrawal of the stem once inserted; whereby when the sleeve is inserted into the wall of a stopper and the stopper is radially compressed, as by insertion into a neck of a bottle, an interference fit occurs between the interference members and the resilient surface of the well, such that, when the puller means has been inserted into the sleeve, upward pulling of the puller means will cause the stopper to be removed from the bottle by reason of interference between the locking means and the detent.

In a further embodiment there is provided, in combination a bottle stopper and stopper-remover comprising cylindrical stopper means of resilient material, the stopper means having top, bottom and side surfaces and a deep well extending into the stopper from the top surface; a hollow sleeve in and substantially conforming in cross-section to the well, the sleeve having top and bottom ends and inner and outer surfaces; a series of protruding interference members on the outer surface, at least one detent member on the inner surface spaced a predetermined distance from the top and bottom; a pair of openings through opposite sides of the sleeve adjacent the detent on a side of the detent remote from the top end; a pair of longitudinal slits extending from respective ones of said openings to a position spaced from said top end; and puller means for insertion into the sleeve, the puller means comprising a top gripper member, an elongated stem and a bottom locking means; the locking means configured to cause the sleeve to expand to allow passage through the detent of the locking means when the stem is inserted into the top end of the sleeve, but to prevent withdrawal of the stem once inserted; whereby when the stopper is radially compressed, as by insertion into a neck of a bottle, an interference fit occurs between the interference members and the resilient surface of the well, such that, when the puller means has been inserted into the sleeve, upward pulling of the puller means will cause the stopper to be removed from the bottle by reason of interference between the locking means and the detent.

In a further embodiment the longitudinal slits extend out to the top end of the sleeve

DETAILED DESCRIPTION OF THE PREFERRED EMBODIMENTS

Figure 2:
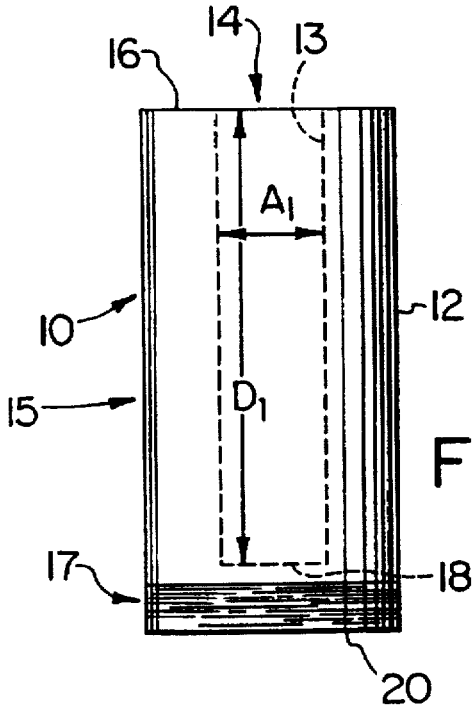
FIG. 2 is an elevational view of a cork for use with the invention, showing in discontinuous lines a well therein.

With reference to FIG. 2, there is shown stopper 10, preferably of cork having outer side surface 12 and a coaxial, right cylindrical shaped well 14 of a predetermined diameter which may be drilled in stopper 10 by known technology. Well 14 extends from top surface 16 to a bottom 18, short of the bottom surface 20 of the stopper.

When the stopper 10 is of the preferred cork material, an upper part 15 is preferably formed of composition cork and a lower part 17 is preferably a cork disc having its grain running transverse to the longitudinal direction of stopper 10.

Figure 3:
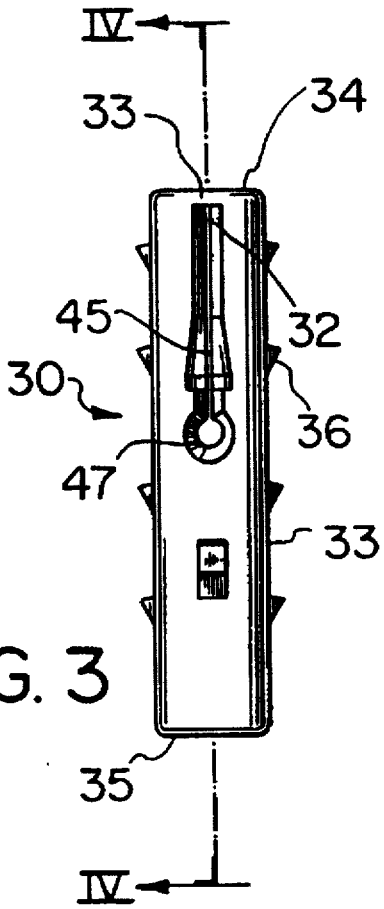
FIG. 3 is an elevational view of the exterior of a sleeve for use in the invention.
Figure 4:
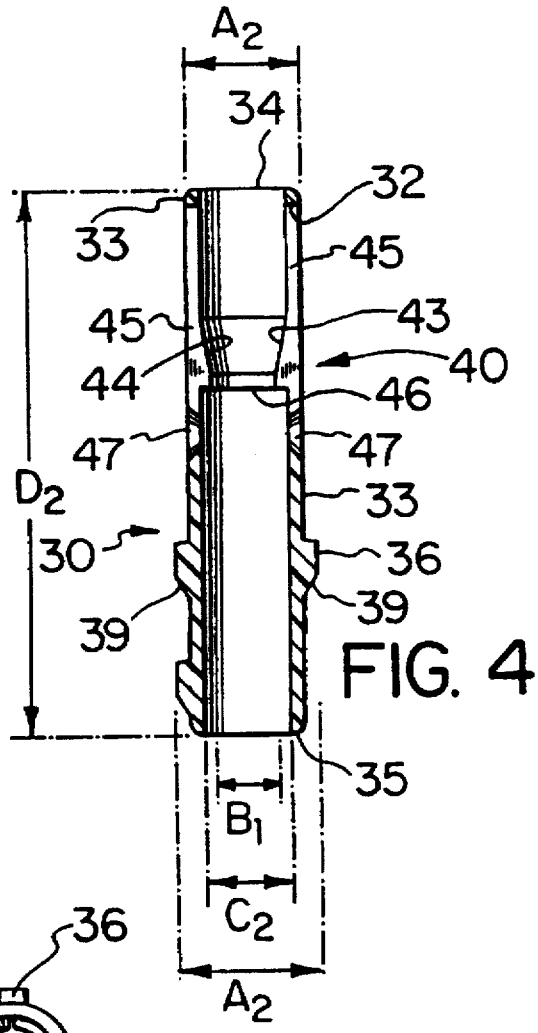
FIG. 4 is a longitudinal sectional view of the sleeve of FIG. 3.

FIGS. 3 and 4 show a sleeve 30 for insertion into well 14. Sleeve 30 is preferably formed of a medium hard polyester resin, such as polyethylene, preferably having a generally cylindrical configuration from top 34 to bottom 35 and with internal surface 32 and external surface 33. Externally, insert 30 has a plurality of peripherally and longitudinally spaced generally rectangular shaped projections or lugs 36. Lugs 36 preferably have a sloped leading surface 39. Although interference means in the form of circumferentially extending ribs are possible, lugs 38 are a preferred configuration since they provide enhanced interference surfaces between sleeve 30 and side wall 13 of well 14 without weakening the cork material as much as do circumferentially extending ribs.

Internally, sleeve 30 has a restriction 40 intermediate top 34 and bottom 35.

Figure 7:
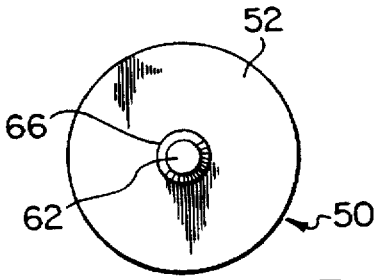
FIG. 7 is a bottom view of the puller means shown in FIG. 5.
Figure 8:
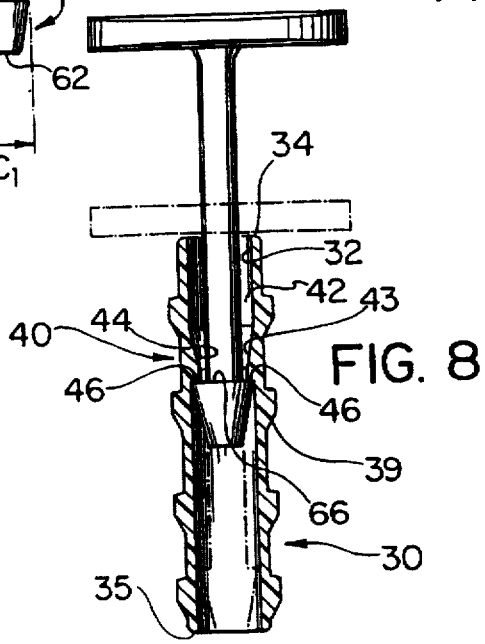
FIG. 8 is a longitudinal section through an assembled sleeve and puller means for use in the invention.

The restriction 40 is preferably formed by a gradual narrowing of interior 42 of sleeve 30 (best seen in FIGS. 4 and 7). The ramps or wedge-like camming surfaces 43 and 44 extend around interior surface 32, broken by slits 45 described below. Surfaces 43 and 44 terminate abruptly at a detent preferably in the form of a shoulder 46.

A pair of small openings 47 through sleeve 30 are located adjacent shoulder 46 on a side thereof opposite to top end 34. A corresponding pair of slits 45 extend from an initial position 32 spaced from end 34 to the openings 47. Slits 45 interrupt the shoulder 46. Openings 47 are preferably of circular cross-section and small diameter.

The beginning point 32 of slits 45 is preferably spaced about 2 mm from end 34 of sleeve 30. The resulting uninterrupted part 33 of sleeve 30 aids in maintaining the integrity of the circular cross-section of sleeve 30 during the compression step described later. Part 33 performs the same function on cork removal, maintaining integrity of sleeve 30 at its extremity and hence also aiding in maintaining the integrity of restriction 40 during cork removal.

Figure 9:
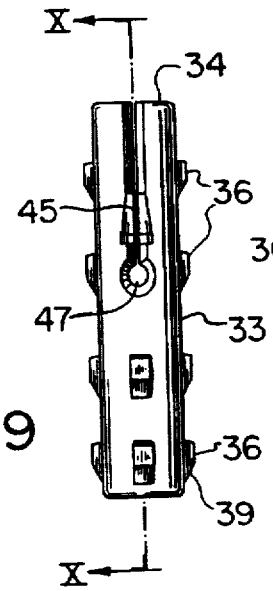
FIG. 9 is an elevational view of the exterior of another embodiment of a sleeve for use in the invention.
Figure 10:
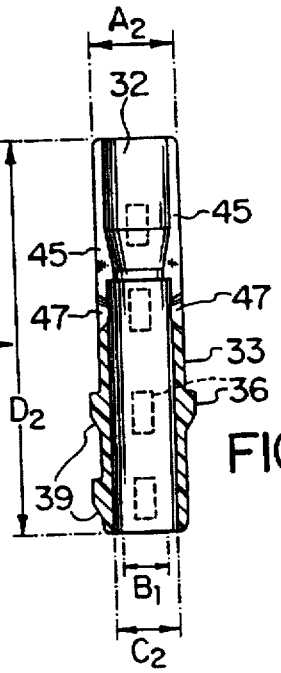
FIG. 10 is a longitudinal sectional view of the sleeve of FIG. 9.

FIGS. 9 and 10 illustrate an embodiment in which slits 45 extend to the end 34 of sleeve 30. This embodiment is otherwise similar to that of FIGS. 1 to 8.

It is noted that while the preferred configuration for well 14 and sleeve 30 is cylindrical, other suitable cross-sections may be found suitable.

Sleeve 30 can be easily molded of plastic according to known technology.

Figure 5:
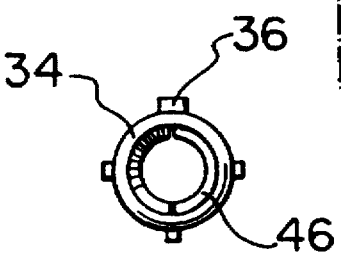
FIG. 5 is a top plan view of the sleeve of FIG. 8.
Figure 6:
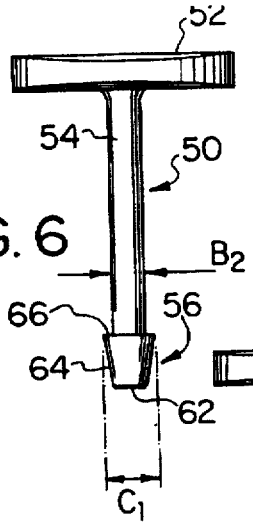
FIG. 6 is an elevational view of puller means for use in the invention.

FIGS. 5 and 6 show a side elevational view and bottom view of puller means 50 which comprises generally circular top gripper member 52 and integral cylindrical shank portion 54, shank 54 having at the end thereof a locking means comprising the expanded truncated come 56 having a generally flat lower end 62; outwardly and upwardly slanted or sloped outer face 64, and upper abutment or shoulder 66.

The diameter $A_1$ of well 14 (FIG. 2) is substantially the same as the diameter $A_2$ of insert 30 taken across diametrically opposed lugs 36 (FIG. 4).

The inner diameter $B_1$ of collar or restriction 40 (FIG. 4) is slightly greater than the diameter $B_2$ of shank portion 54. The diameter $C_1$ at shoulder 66 of cone 56 is just less than the diameter of $C_2$ of sleeve 30 both above and below restriction 40.

The length of shank portion 54 is substantially the length of well 14 but no longer; and the diameter of gripper member 52 is substantially that of the outer diameter of lip 53 of the neck 72 of a bottle into which stopper 10 is to be inserted. The length $D_1$ of well 14 is preferably at least slightly greater than the length $D_2$ of sleeve 30.

Figure 1:
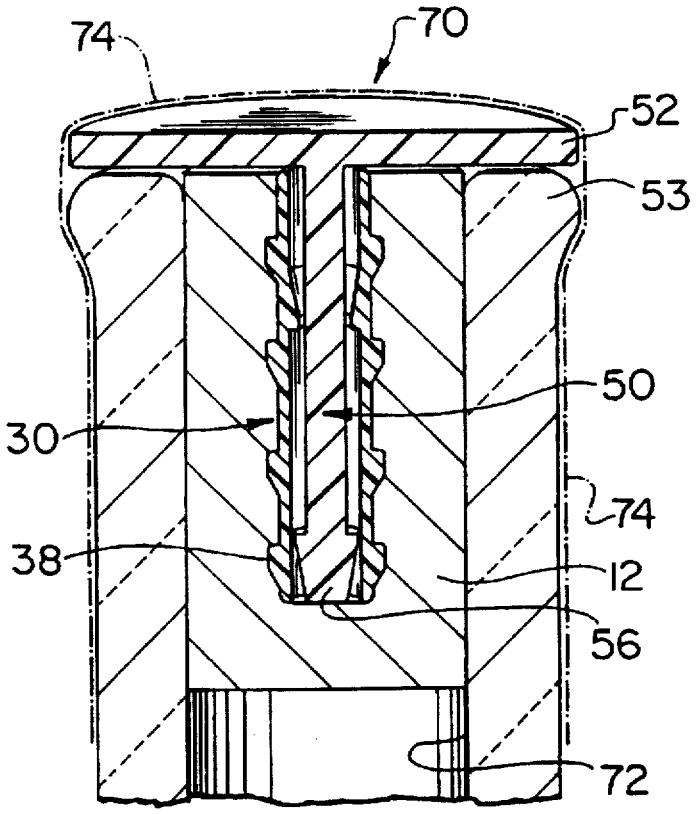
FIG. 1 is a front perspective view, in section, of one embodiment of the invention in the neck of a bottle.

FIGS. 2, 4 and 5 illustrate the stopper parts which in FIG. 1 are assembled in the neck of a bottle.

FIG. 7 shows the sleeve 30 and the puller means 50 assembled without stopper 10. In use and with stopper 10 in a rest condition in terms of radial compression; i.e. one where it is not under any substantial stress, insert 30 is longitudinally inserted into well 14. The assembled stopper 10 and insert 30 are ready for use in sealing a wine bottle or the like. During assembly of the stopper assembly 70 with a wine bottle, the stopper 10 is highly radially compressed and inserted into the neck 72 of the wine bottle, the radial compression of the stopper portion 10 causing a tight, longitudinally and radially uniform grip to be formed between the stopper 10 and projections 36 of sleeve 30. The assembled cork/insert can be used with known and existing corking machines and no modification of such machines is required.

The shaft portion 54 of puller 50 is inserted within sleeve 30. As the shoulder 66 of end 56 of shaft 54 engages and moves along the camming surfaces 43 and 44, the slits 45 and openings 47 permit a camming action to force sleeve 30 to momentarily expand to permit shoulder 66 on shaft 54 to pass by shoulder 46 in sleeve 30.

It will be appreciated that puller member 50 could be assembled with sleeve 30 and stopper 10 as shown in FIG.

7 prior to the stopper 10 being inserted into the neck of a bottle or prior to sleeve 30 being inserted into well 14. When stopper 10, sleeve 30 and puller member 50 are preassembled before corking a bottle, the width of top 52 of member 50 is substantially the width of the uncompressed cork 10 which is substantially the outside diameter of the neck of a wine bottle. Top 52 of member 50 is also in contact with top surface 16 of stopper 10 so that any downward pressure on top 52 is transferred to surface 16 and not transmitted through shank 54 to end 62 and bottom 18 of well 14. With this alternative, some modification to existing corking machine may be made whereby the radial compression means excludes radial contact with cap 52.

After the stopper is fully assembled with the bottle, the usual dust covering, shown by dotted line 74 in FIG. 1, is applied over stopper assembly 70 and bottle neck 72.

When wine is to be served, foil 74 is stripped off and top 52 of member 50 grasped such as between the first and second fingers and pulled upwardly. Shoulder 66 then contacts the bottom of shoulders 46 (FIG. 7). Further upward force then causes the insert and cork to be pulled out of the bottle neck 72 as a unit.

By way of further illustration of the novel stopper, exemplary dimensions are as follows where the stopper is of cork to be inserted into a typical wine bottle. Cork 10 is about 45 mm long with an uncompressed diameter of about 24 mm, well 14 being about 10 mm in diameter by 38 mm long. Sleeve 30 is 38 mm long with an internal diameter of about 6 mm decreasing at restriction 40 to about 4 mm. The outer diameter from lug to lug of sleeve 30 is 10 mm and the thickness of the walls is about 1 mm. Lugs 36 are about 3 mm (long) by 2 mm (wide) by 1 mm (thick) and are generally evenly spaced longitudinally and circumferentially with the first or lowest four lugs about 3 mm from the outer surface of bottom 35. Puller means 50 has a top gripper member 52 of about 26 mm diameter and 4 mm thickness with shank 54 being about 4 mm diameter. Shank 54 is about 37 mm long and shoulders 36 have outer diameters of about 6 mm.

It will be apparent that various modifications and variations may be effected to my invention without departing from the spirit thereof and I claim all such modifications within the scope of the appended claims.

The embodiments of the invention in which an exclusive property or privilege is claimed are defined as follows:

1. In combination a bottle stopper and stopper-remover comprising:

a cylindrical stopper (10) of resilient material, said stopper having top (16), bottom (20) and side surfaces (12) and a deep well (14) extending into said stopper (10) from said top surface (16);

a hollow sleeve (30) in and substantially conforming in cross-section to said well (14), said sleeve (30) having top (34) and bottom (35) ends and inner (32) and outer (33) surfaces; a series of protruding interference members (36) on said outer surface (33), at least one detent member (46) on said inner surface (32) spaced a predetermined distance from said top (34) and bottom (35); a pair of openings (47) through opposite sides of said sleeve (30) adjacent said detent (46) on a side of said detent remote from said top end (34); and a pair of longitudinal slits (45) extending from respective ones of said openings (47) toward said top end (34); and puller means (50) for insertion into said sleeve (30), said puller means (50) comprising a top gripper member (52), an elongated stem (54) and a bottom locking means (56); said locking means configured to cause said sleeve (30) to expand to allow passage through said detent (46) of said locking means (56) when said stem (54) is inserted into said top end (34) of said sleeve (30), but to prevent withdrawal of said stem once inserted;

whereby when said stopper (10) is radially compressed, as by insertion into a neck of a bottle, an interference fit occurs between said interference members (36) and the resilient surface (13) of said well, such that, when said puller means (50) has been inserted into said sleeve (30), upward pulling of said puller means will cause said stopper to be removed from said bottle by reason of interference between said locking means and said detent.

2. The combination of claim 1 wherein said slits (45) terminate at a position spaced from said top end (34).

3. The combination of claim 2 wherein said stopper (10) is comprised of cork.

4. The combination of claim 2 wherein said sleeve (30) and said puller means (50) are comprised of plastic.

5. The combination of claim 2 wherein said well (14) and said sleeve (30) are cylindrical.

6. The combination of claim 5 wherein the diameter of said sleeve (30), including said projections (36), is approximately equal to the diameter of said well (14) prior to said radial compression.

7. The combination of claim 2 wherein said detent (46) comprises a concentric shoulder within said sleeve (30), said shoulder split by said slits (45).

8. The combination of claim 7 wherein said shoulder comprises a concentric ring (46) in said sleeve (30).

9. The combination of claim 8 wherein said shoulder includes at least one camming surface (43/44) forming a ramp leading up to said shoulder from said inner surface (32) of said sleeve (30), a bottom of said ramp flush with said inner surface intermediate said top of said sleeve and said shoulder.

10. The combination of claim 2 wherein said openings (47) are circular and of small diameter.

11. The combination of claim 2 wherein said gripper member (52) is profiled to facilitate a finger grip.

12. The combination of claim 2 wherein said stem (54) is cylindrical.

13. The combination of claim 12 wherein the diameter ($B_2$) of said stem (54) is less than the diameter ($B_1$) of said sleeve (30) at said detent (46), whereby said stem if free to slide through said detent.

14. The combination of claim 2 wherein said locking means (56) comprises a concentric shoulder (66) on said stem (54) of greater diameter ($C_1$) than the diameter ($B_1$) of said sleeve (30) at said detent (46).

15. The combination of claim 14 wherein said concentric shoulder (66) is formed by a truncated cone, the top of which forms the end of said stem (54) and the base of which comprises said concentric shoulder (66) spaced from said end of said stem (54).

16. The combination of claim 2 wherein said projections (36) are profiled to permit easy insertion of said sleeve (30) into said well (14) but to resist withdrawal of said sleeve from said well.

17. The combination of claim 2 wherein said sleeve (30), said interference members (36) and said detent (46) are an integral unit.

18. The combination of claim 2 wherein said top gripper member (52), said stem (54) and said locking means (56) are an integral unit.

19. The combination of claim 1 wherein said slits (45) extend from said openings (47) to said top end (34).

20. In combination a bottle stopper and stopper-remover comprising:

a cylindrical stopper (10) of cork, said stopper having top (16), bottom (20) and side surfaces (12) and a deep cylindrical well (14) extending centrally into said stopper (10) from said top (16) surface;

a hollow plastic sleeve (30) in and substantially conforming in cross-section to said well (14), said sleeve (30) having top (34) and bottom (35) ends and inner (32) and outer (33) surfaces; a series of protruding interference members (36) on said outer surface (33), a detent member (46) on said inner (32) surface spaced a predetermined distance from said top (34) and bottom (35) and comprising a concentric shoulder; a pair of openings (47) through opposite sides of said sleeve (30) adjacent said detent (46) on a side of said detent remote from said top end (34); and a pair of longitudinal slits (45) extending from respective ones of said openings (47) toward said top end (34) and passing through said ring; and puller means (50) for insertion into said sleeve (30), said puller means (50) comprising a top gripper member (52), an elongated stem (54) and a bottom locking means (56); said locking means configured to cause said sleeve (30) to expand to allow passage through said detent (46) of said locking means (56) when said stem (54) is inserted into said top end (34) of said sleeve (30), but to cause said locking means to prevent withdrawal of said stem once inserted;

whereby when said stopper (10) is radially compressed, as by insertion into a neck of a bottle, an interference fit occurs between said interference members (36) and the resilient surface (13) of said well, such that, when said puller means (50) has been inserted into said sleeve (30), upward pulling of said puller means will cause said stopper to be removed from said bottle by reason of interference between said locking means and said detent.

21. The combination of claim 20 wherein said slits (45) extend to a position spaced from said top end (34).

22. The combination of claim 20 wherein said slits (45) extend from said opening to said top end (34).

23. A bottle stopper remover for use with a bottle stopper where said stopper is cylindrical and of resilient material and has top (16), bottom (20) and side surfaces (12) and a deep well (14) extending into said stopper (10) from said top surface (16);

said stopper remover comprising:

a hollow sleeve (30) substantially conforming in cross-section to said well (14), said sleeve (30) having top (34) and bottom (35) ends and inner (32) and outer (33) surfaces; a series of protruding interference members (36) on said outer surface (33), a detent member (46) on said inner surface (32) spaced a predetermined distance from said top (34) and bottom (35); a pair of openings (47) through opposite sides of said sleeve (30) adjacent said detent (46) on a side of said detent remote from said top end (34); and a pair of longitudinal slits (45) extending from respective ones of said openings (47) toward said top end (34); and puller means (50) for insertion into said sleeve (30), said puller means (50) comprising a top gripper member (52), an elongated stem (54) and a bottom locking means (56); said locking means configured to cause said sleeve (30) to expand to allow passage through said detent (46) of said locking means (56) when said stem (54) is inserted into said top end (34) of said sleeve (30), but to cause said locking means to prevent withdrawal of said stem once inserted;

whereby when said sleeve (30) is inserted into said well (14) of a stopper and said stopper is radially compressed, as by insertion into a neck of a bottle, an interference fit occurs between said interference members (36) and the resilient surface (13) of said well, such that, when said puller means (50) has been inserted into said sleeve (30), upward pulling of said puller means will cause said stopper to be removed from said bottle by reason of interference between said locking means and said detent.

24. The bottle stopper remover of claim 23 wherein said slits (45) terminate at a position spaced from said top end (34).

25. The stopper remover of claim 23 wherein said slits (45) extend from said opening to said top end (34).

* * * * *